United States Patent [19]

Zwiren et al.

[11] 4,187,866

[45] Feb. 12, 1980

[54] COMB WITH ROTATABLE TEETH

[75] Inventors: Jan M. Zwiren, Chicago, Ill.; Selma M. Casper; Norman Sinclair, both of New York, N.Y.

[73] Assignee: Helene Curtis Industries, Inc., Chicago, Ill.

[21] Appl. No.: 907,789

[22] Filed: May 19, 1978

[51] Int. Cl.[2] ..... A45D 24/00

[52] U.S. Cl. ..... 132/151

[58] Field of Search ..... 132/151, 142, 163, 152; 29/433, 434, 453

[56] References Cited

U.S. PATENT DOCUMENTS

| | | | |
|---|---|---|---|
| 2,808,062 | 10/1957 | Schiffman | 132/151 |
| 3,133,546 | 5/1964 | Dent | 132/120 |
| 3,855,689 | 12/1974 | Schiffman | 132/151 |

*Primary Examiner*—G. E. McNeill

*Attorney, Agent, or Firm*—Dressler, Goldsmith, Clement, Gordon & Shore, Ltd.

[57] ABSTRACT

A comb including an elongated body having a recess extending from one edge thereof with an insert having teeth supported thereon received into the recess is disclosed herein. The respective teeth are supported in openings in the insert and have enlarged heads at one end which are located between the base wall of the recess and the adjacent surface of the insert and have an axial dimension less than the spacing therebetween so that the respective teeth can move axially as well as rotate about their own axes during use of the comb.

8 Claims, 5 Drawing Figures

COMB WITH ROTATABLE TEETH

BACKGROUND OF THE INVENTION

The present invention relates generally to combs and more specifically to combs having teeth which are individually freely rotatable about their own axes.

Combs having axially rotatable teeth have been known for years and examples of such combs are disclosed in U.S. Pat. Nos. 1,330,675; 2,808,062; and 3,855,689.

While these prior art disclosures have been in existence for many years, combs with rotatable teeth have not found any real degree of commercial success. One of the reasons for the lack of commercial success of such type of combs is believed to be that, while the teeth of such combs are designed to be rotatable, the inherent construction of the combs retards free rotation of the teeth.

SUMMARY OF THE INVENTION

According to the present invention, the teeth of a comb are supported in such a fashion so as to be rotatable and axially movable with respect to the support portion of the comb. Such an arrangement not only enhances the rotatability of the respective teeth with respect to the support structure but also allows the free end of the teeth to assume different positions to accommodate the contour of the user's head.

More specifically, the comb of the present invention includes an elongated body having an elongated recess extending from one edge with the recess having a base wall and opposed sidewalls. An elongated insert having a plurality of spaced openings with teeth rotatably supported in the opening is received into the recess. Each of the teeth has an enlarged head located within the recess and the recess and insert are positioned such that the axial dimension of the enlarged heads is less than the spacing between the base wall of the recess and the adjacent surface of the insert. In addition, the maximum diameter of the enlarged head is less than the spacing between the opposed sidewalls of the recess to eliminate any restriction of rotation of the respective teeth in their openings.

In one embodiment of the invention, a single row of teeth is located in the insert while in a second embodiment, two rows of teeth are provided for the comb. In this version of the invention, the teeth of the respective rows may be aligned or staggered.

DETAILED DESCRIPTION

Figure 1:
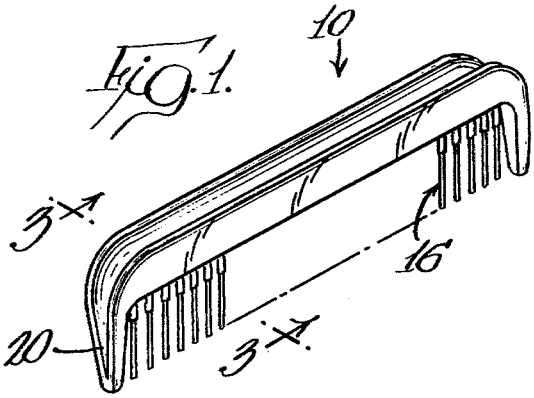
FIG. 1 is a perspective view of a comb constructed in accordance with the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

Figure 2:
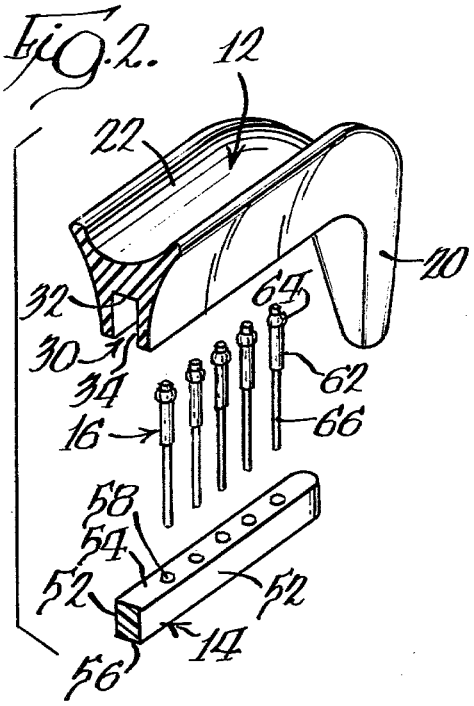
FIG. 2 is an exploded fragmentary view of the parts of the comb.

FIG. 1 of the drawings shows a comb generally designated by reference numeral 10. Comb 10 consists of three components including an elongated body 12 (FIG. 2) an elongated insert 14 and a plurality of identical teeth 16.

Elongated body or frame 12 is preferably composed of a plastic material that has integral end portions 20 that extend substantially perpendicular to the main body portion 22 and terminate at free ends spaced from the main body portion 22. Main body portion 22 has a bottom wall 24, generally flared sidewalls 26 and a generally concave top wall or surface 28 to produce an aesthetically pleasing body that may readily be gripped by the two projections 29 defined between sidewalls 26 and top wall 28.

Figure 3:
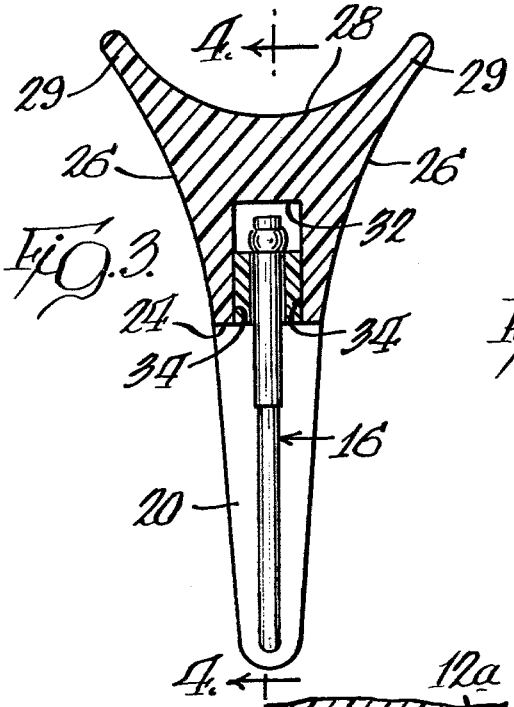
FIG. 3 is a sectional view as viewed along line 3—3 of FIG. 1.
Figure 4:
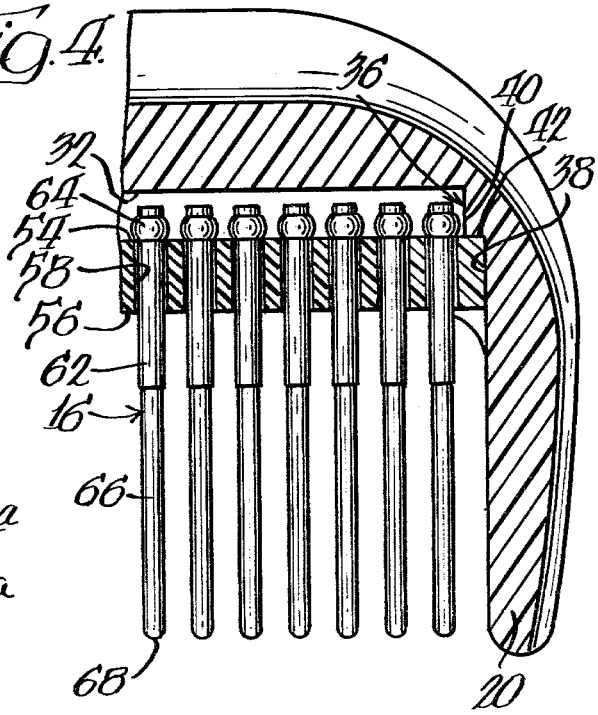
FIG. 4 is a sectional view as viewed along line 4—4 of FIG. 3.

Elongated body 12 also has an elongated recess 30 extending the entire length thereof and recess 30 has a base wall 32 and opposed sidewalls 34 which extend parallel to each other and produce a substantially rectangular recess or opening 30 as illustrated in FIG. 3. As shown in FIG. 4, recess 30 also has a pair of end walls 36 (only one being shown) and each end wall has a first portion 38 and a second portion 40 producing a stepped configuration to define a shoulder 42 for a purpose that will be described later.

Insert 14 is also generally rectangular in cross section and has opposed sidewalls 52 and a top wall 54 as well as a bottom wall 56. Opposed sidewalls 52 extend parallel to each other and are spaced from each other by a dimension that is substantially identical to the spacing between sidewalls 34 of recess 30 so as to snugly fit into the recess. The length of insert 14 is such that the opposite ends are received into the lower portion 38 of end wall 36 and the upper wall 54 abuts against shoulders 42 to produce a predetermined spacing between upper wall 54 of insert 14 and base wall 32 of recess 30, for a purpose that will be described later.

Insert 14 has a plurality of circular openings 58 produced therein and each of the openings 58 receives a tooth 16 to produce a row of teeth that are located in a common plane. Each tooth 16 consists of a central or intermediate shank portion 62 which is received into opening 58, an enlarged head portion 64 at the upper end of tooth 16 and a lower reduced diameter portion 64 which terminates at its lower end into a rounded tip portion 68.

According to the primary aspect of the present invention, the enlarged head portion 64 of each tooth 16 is dimensioned and configured to accommodate substantially free rotation as well as axial movement of the teeth 16 within openings 58. Thus, the enlarged head 64 of each tooth 58 has an axial dimension which is less than the spacing between base wall 32 and top wall 54 of recess 30 and insert 14 respectively. With this arrangement, the respective teeth may be shifted axially by a dimension equal to the difference between the spacing of parallel walls 32 and 54 and the axial dimension of head portion 64. Also, the diameter or transverse dimension of the enlarged head 64 is less than the spacing between opposed sidewalls 34 of recess 30.

In assembling the novel comb 10, all of the respective teeth are inserted into the respective openings 58 of insert 14 so that the free end portions or rounded tips 68 extend downwardly and are substantially aligned with the lower edges of end portions 20 of body 12. The entire insert is then moved into recess 30 until top wall 54 engages shoulders or abutments 42 at opposite ends of recess 30. The plastic insert and the plastic body may then be sonically welded to each other to define a permanent connection and prevent the teeth from being separated from the comb. Because of the configuration of the enlarged head portions 54 of the teeth 16 and the dimensions of the rectangular opening produced between the insert 14 and recess 30, the entire tooth can be rotated axially within opening 58 and can also be shifted axially so that the lower tip portions 68 are no longer in a common plane.

Figure 5:
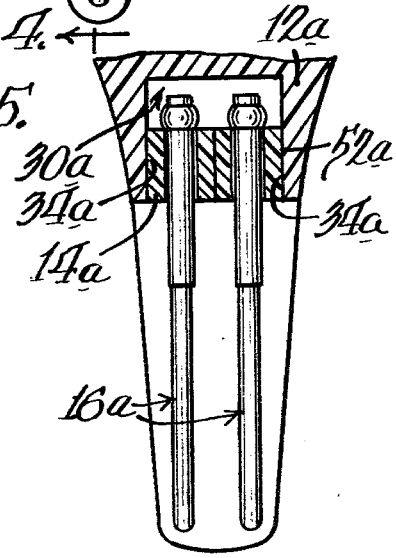
FIG. 5 is a view similar to FIG. 3 showing a modified form of the invention.

A slightly modified form of the invention is illustrated in FIG. 5 and, since most parts are identical, the same reference numerals have been used with the addition of a suffix. In the embodiment illustrated in FIG. 5, two rows of teeth 16*a* are produced in a single comb. In this embodiment, the recess 30*a* has opposed sidewalls 32*a* which are spaced from each other by a dimension that is equal to twice the width of an insert 14*a*. Two inserts 14*a* of identical configuration to each other and to insert 14 are positioned in contiguous engagement with each other and the respective exposed sidewall 52*a* are in contiguous engagement with the respective sidewalls 34*a* of recess 30*a*. In this embodiment, the respective pairs of rows of teeth may be aligned with each other as illustrated in FIG. 5 or may be staggered with respect to each other in the respective rows.

In the embodiment illustrated in FIG. 5, two separate members 14*a* have been illustrated, however, it will be appreciated that a single insert member having two sets of openings could readily be substituted for the separate illustrated members.

In both embodiments of the invention, the material for body 12 and insert 14 are preferably composed of a fairly rigid plastic composition while the teeth are preferably formed from a metal composition.

As can be appreciated from the above description, in both embodiments of the invention, the rotatability of the teeth within the respective openings is substantially unobstructed and gives greater flexibility of the movement of the teeth axially as well as rotationally.

What is claimed is:

1. A comb comprising an elongated body having integral end portions extending generally perpendicular, said body having a substantially rectangular recess extending from a surface thereof between said end portions, said recess having a base wall, opposed sidewalls and opposed end walls, each end wall having a stepped configuration to produce a shoulder spaced from said base wall, an insert located in said recess and having opposite ends engaging said shoulder to produce a space between said base wall and an adjacent surface of said insert, said insert having a plurality of spaced circular openings with rotatable teeth located in the respective openings and extending from an opposed surface of said insert, each of said teeth having an enlarged head located between said base wall and said adjacent surface, each enlarged head having an axial dimension less than the spacing between said base wall and said adjacent surface to accommodate axial movement of said teeth in said openings.

2. A comb as defined in claim 1, in which each head of each of said teeth is spaced from said sidewalls to be freely rotatable in said openings.

3. A comb as defined in claim 1, in which said insert has a pair of transversely spaced rows of openings with teeth in each of said openings.

4. A comb as defined in claim 1, in which each of said teeth has an enlarged shank portion adjacent said head with the enlarged shank portion located in the associated opening.

5. A comb as defined in claim 1, in which said adjacent surface of said insert extends parallel to said base wall.

6. A comb as defined in claim 1, in which said insert includes first and second rectangular members of substantially identical configuration each having a plurality of openings with teeth in said openings and in which said members are in contiguous engagement with each other and respectively with the respective sidewalls of said recess.

7. A comb as defined in claim 6, in which said openings are positioned to produce two parallel rows of teeth.

8. A comb comprising an elongated body having an elongated recess extending from one edge thereof, said recess having a base wall spaced from said edge and opposed sidewalls, an elongated insert located in said recess and having a transverse dimension equal the spacing between said opposed sidewalls, said insert having a plurality of spaced circular openings, a circular tooth located in each of said openings, each tooth having an enlarged head located within said recess between said base wall and an adjacent surface of said insert, each head having an axial dimension less than the spacing between said base wall and an adjacent surface of said insert to accommodate axial movement of said teeth within the respective openings, each head having a maximum diametric dimension less than the spacing between said sidewalls to accommodate free rotational movement in the adjacent opening.

* * * * *